US007745997B2

(12) United States Patent
Cho

(10) Patent No.: US 7,745,997 B2
(45) Date of Patent: Jun. 29, 2010

(54) MULTI-ELECTRODES DOUBLE TUBE FLUORESCENT LAMP

(75) Inventor: Guang-Sub Cho, Seoul (KR)

(73) Assignee: Kwang Woon Display Technology Co., Ltd., Seoul (KR)

( * ) Notice: Subject to any disclaimer, the term of this patent is extended or adjusted under 35 U.S.C. 154(b) by 789 days.

(21) Appl. No.: 11/550,591

(22) Filed: Oct. 18, 2006

(65) Prior Publication Data

US 2007/0159103 A1 Jul. 12, 2007

(30) Foreign Application Priority Data

Jan. 7, 2006 (KR) ..... 10-2006-0002032

(51) Int. Cl.
*H01J 17/44* (2006.01)
*H01J 61/54* (2006.01)

(52) U.S. Cl. ..... 313/594; 313/595

(58) Field of Classification Search ..... 313/594, 313/234, 595, 567

See application file for complete search history.

(56) References Cited

FOREIGN PATENT DOCUMENTS

| | | | |
|---|---|---|---|
| KR | 10-2004-0022376 | | 3/2004 |
| WO | WO2004023518 | * | 3/2004 |

* cited by examiner

*Primary Examiner*—Toan Ton
*Assistant Examiner*—Zachary Snyder
(74) *Attorney, Agent, or Firm*—Lowe Hauptman Ham & Berner LLP

(57) ABSTRACT

A multi-electrode double tube fluorescent lamp includes first external electrodes formed at two ends of an outer glass tube or an inner glass tube, and a second external electrode formed at an inner wall surface of the inner glass tube in a longitudinal direction. A first power source is connected with the first external electrode, and a second power source is connected with the second external electrode. A third external electrode formed along an outer surface of the outer glass tube is connected with the second power source. The second external electrode and the third external electrode are arranged in a radial shape in a direction vertical with respect to the longitudinal direction.

9 Claims, 12 Drawing Sheets

MULTI-ELECTRODES DOUBLE TUBE FLUORESCENT LAMP

CROSS REFERENCE

Applicant claims foreign priority under Paris Convention and 35 U.S.C. §119 to a Korean Patent Application No. 10-2006-0002032, filed Jan. 7, 2006 with the Korean Intellectual Property Office.

TECHNICAL FIELD

The present invention relates to a fluorescent lamp, and in particular to a multi-electrode double tube fluorescent lamp and a driving method of the same which are capable of preventing a plasma channeling phenomenon which occurs in a discharge tube of a double tube fluorescent lamp formed of two cylindrical glass tubes.

BACKGROUND ART

Based on a structure and operation method of an electrode, a conventional fluorescent lamp is classified into a HCFL (Hot Cathode Fluorescent Lamp), a CCFL (Cold Cathode Fluorescent Lamp), and an EEFL (External Electrode Fluorescent Lamp). In the HCFL and CCFL, an electrode is installed at two ends of a discharge space of the interior of a glass tube, respectively. A high voltage is supplied to the electrode for thereby generating a fluorescent light based on a discharge operation. However, the life span of the lamp is short.

In the EEFL, a glass tube is sealed, and an external electrode is installed at an outer wall of two ends of the glass tube. With this construction, the external electrode allows an electric field to be formed within the glass tube based on a capacitive coupling operation with the wall of the glass tube. The above method has a longer life span as compared to the HCFL and CCFL.

The HCFL having a tube diameter of a few centimeters has been used for a common fluorescent lamp, which needs a lot of light intensity or has been used when a power capacity is large. The CCFL and EEFL each having a tube diameter of a few millimeters has been used for a high luminance backlight or has been used when the power capacity is low.

Generally, the tube diameter of the lamp is related with light intensity based on the luminance and power capacity. As the tube diameter decreases, a higher luminance may be produced. Since the light emitting area of the fluorescent lamp is small, the light intensity is low. On the contrary, as the tube diameter increases, the luminance decreases. In this case, since the area of light emission increases, it may be well adapted to a high electric power source, which has a high light intensity. In particular, in the case of the EEFL, a small tube having a tube diameter of a few millimeters is used so as to obtain a high luminance. However, the EEFL may obtain a high luminance, but the light intensity is less. So, it is known that a high luminance cannot be obtained by simply increasing the inner diameter of the EEFL.

FIGS. 1A through 1C are views illustrating a conventional double tube fluorescent lamp. As shown in FIG. 1A, a double tube fluorescent lamp 1 comprises an outer glass lamp 10, and an inner glass lamp 11 which is formed in the interior of the outer glass tube 10. The inner and outer glass lamps are arranged at the same axis. The double tube fluorescent lamp 1 is fabricated by sealing and binding the two ends of the outer glass tube 10 and inner glass tube 11.

FIG. 1B is a cross sectional view taken in a vertical longitudinal direction of a double tube fluorescent lamp 1. Here, the cross section of a discharge shape formed between an inner wall of the outer glass wall 10 and an outer wall of the inner glass wall 1 is a circular shape, and the space formed at an inner side of the inner wall of the inner glass tube 11 is empty. Fluorescent layers 20 and 21 are coated at an inner wall of the outer glass tube 10 and an outer wall of the inner glass tube 11, respectively, with a discharge space being formed by them. A discharge gas is filled in the discharge space.

FIG. 1C is a cross sectional view taken in a vertical longitudinal direction of the double tube fluorescent lamp 1. A cylindrical empty space is formed at an inner side of the inner wall of the inner glass tube 11, and a discharge space is formed between an inner wall of the outer glass tube 10 and an outer wall of the inner glass tube 11.

Thus, the double tube fluorescent lamp generates light in such a manner that electrodes are formed outside the glass tubes which conventionally forms a double tube, and high voltage is applied to the above electrodes, and plasma is generated from the discharge gas filled in the discharge space, and then an ultraviolet ray generating from the plasma allows the fluorescent layer to excite, with the fluorescent layer being coated on the walls of the glass tube.

The Korean patent No. 10-0433193 discloses the construction of an external electrode for driving the double tube fluorescent lamp and a driving method using the same. As described in the above patent, in the driving method of the conventional double tube fluorescent lamp, an external electrode is installed between two ends of the glass tube which forms the double tube. One power source is connected with the installed external electrode, so that the plasma is generated based on the longitudinal discharge of the lamp. However, the plasma generating based on the above method is not uniform in the discharge space, and the generation of plasma is limited in the longitudinal direction. Namely, a plasma channeling phenomenon occurs. So, it is impossible to obtain a uniform discharge over the entire portions of the double tube fluorescent lamp. A high efficiency and luminance fluorescent lamp cannot be achieved in the conventional art.

DISCLOSURE

Technical Problem

Accordingly, it is an object of the present invention to provide a multi-electrode double tube fluorescent lamp and a driving method of the same which overcome the problems encountered in the conventional art.

It is another object of the present invention to provide a multi-electrode double tube fluorescent lamp and a driving method of the same which are capable of preventing a plasma channeling phenomenon in which a plasma is not uniformly generated in a discharge space of a double tube fluorescent lamp and improving a uniformity of plasma, so that a high luminance and efficiency double tube fluorescent lamp is obtained.

Technical Solution

To achieve the above objects, there is provided a multi-electrode double tube fluorescent lamp which comprises an outer glass tube; an inner glass tube which is concentrically formed in the interior of the outer glass tube; a discharge space formed between the outer glass tube and the inner glass tube; a pair of first external electrodes which are formed at two ends of the outer glass tube; a second external electrode which is formed at an inner wall surface of the inner glass tube in a longitudinal direction; a first power source which is connected with the first external electrode and guides a discharge of the longitudinal direction of the double tube florescent lamp; and a second power source which is connected with the second external electrode and guides a discharge in a direction vertical with respect to the longitudinal direction of the double tube florescent lamp, wherein the direction of the plasma generated by the first power source and the direction of the plasma generated by the second power source are vertical to each other.

The second external electrodes are arranged in a radial shape in a direction vertical with respect to the longitudinal direction of the inner glass tube for thereby implementing a multiple electrode structure, with a power being supplied so that the opposite poles are formed between the neighboring electrodes.

There is further provided a third external electrode which is formed along an outer surface of the outer glass tube and is connected with the second power source, wherein said external electrodes are formed in a radial shape in a direction vertical with respect to the longitudinal direction for thereby implementing a multiple electrode structure, with a power being supplied so that the opposite poles are formed between the neighboring electrodes.

The multi-electrode double tube fluorescent lamp driving apparatus according to the present invention is designed so that the plasma is generated in the discharge space in the longitudinal direction of the lamp as well as the direction vertical with respect to the longitudinal direction for thereby preventing a channeling phenomenon of plasma. A high luminance and efficiency may be achieved through the double tube fluorescent lamp.

In the multi-electrode double tube fluorescent lamp driving apparatus according to the present invention, the double tube fluorescent lamp is driven using two power sources, and a lower discharge voltage is needed for driving the double tube fluorescent lamp as compared to the conventional art.

In the multi-electrode double tube fluorescent lamp driving apparatus according to the present invention, the first and second power sources each are provided with at least one transformer, and the secondary coil of each transformer is preferably connected with the first and second external electrodes or is preferably connected with one among the first through third electrodes.

The first and second power sources each have at least one different element among a driving voltage, a driving current, a driving frequency, a waveform, an oscillation method and a switching method. The first and second power sources each have at least two transformers, and the primary and secondary coils of at least two transformers are connected with each other in series or in parallel. The first and second power sources have driving frequencies ranged from a few tens of kHz to a few of MHz, The multi-electrode double tube fluorescent lamp driving method according to the present invention is basically designed to drive a double tube fluorescent lamp using the external electrodes with the above construction.

EFFECTS

The multi-electrode double tube fluorescent lamp according to the present invention is basically directed to driving a double tube fluorescent lamp by generating plasma in a certain direction vertical with respect to the longitudinal direction of each lamp based on two power sources. The uniformity of plasma generated in the discharge space of the lamp is significantly improved. The channeling phenomenon of plasma is prevented. The luminance of the double tube fluorescent lamp can be improved.

Since the double tube fluorescent lamp is driven using two power sources, lower discharge voltage is needed, and the discharge efficiency is improved.

In a method of forming electrodes at the inner glass tube or outer glass tube, multiple electrodes are arranged in a radial structure, and the powers are applied so that the neighboring electrodes have opposite poles for thereby achieving uniformity of plasma generated. The intensity of the plasma increases.

BEST MODE

The preferred embodiments of the present invention will be described with reference to the accompanying drawings.

Figure 1A:
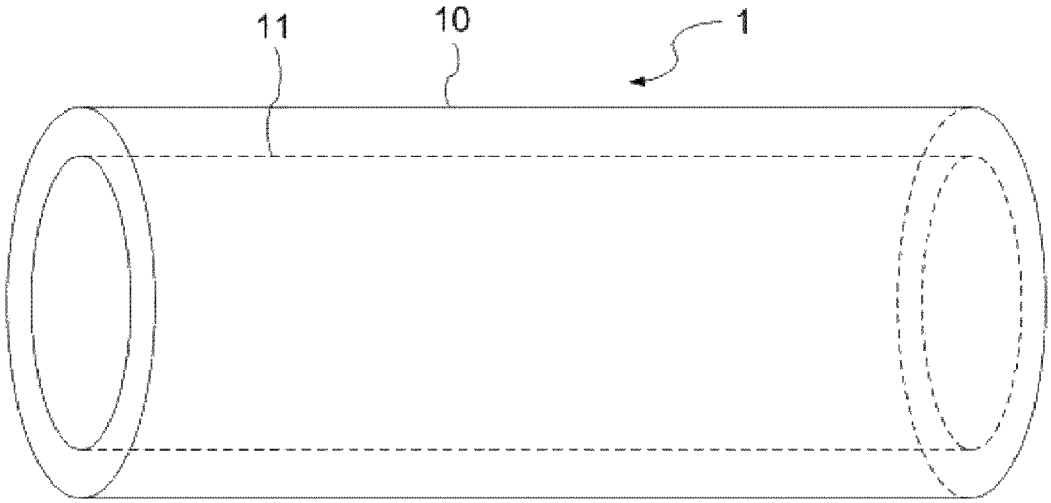
FIG. 1a Prior Art
FIG. 1A is a perspective view illustrating a conventional double tube fluorescent lamp.
Figure 1B:
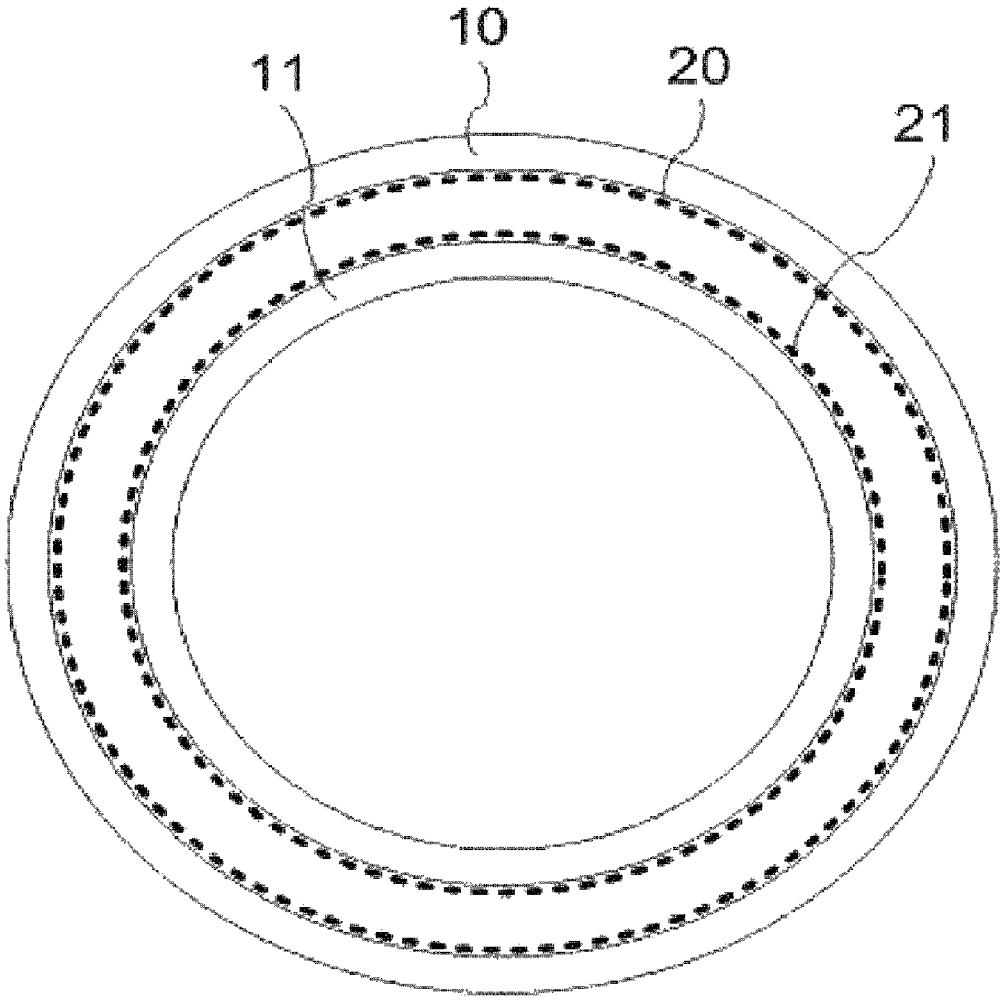
FIG. 1b Prior Art
FIG. 1B is a cross sectional view taken in a vertical longitudinal direction of a double tube fluorescent lamp of FIG. 1A.
Figure 1C:
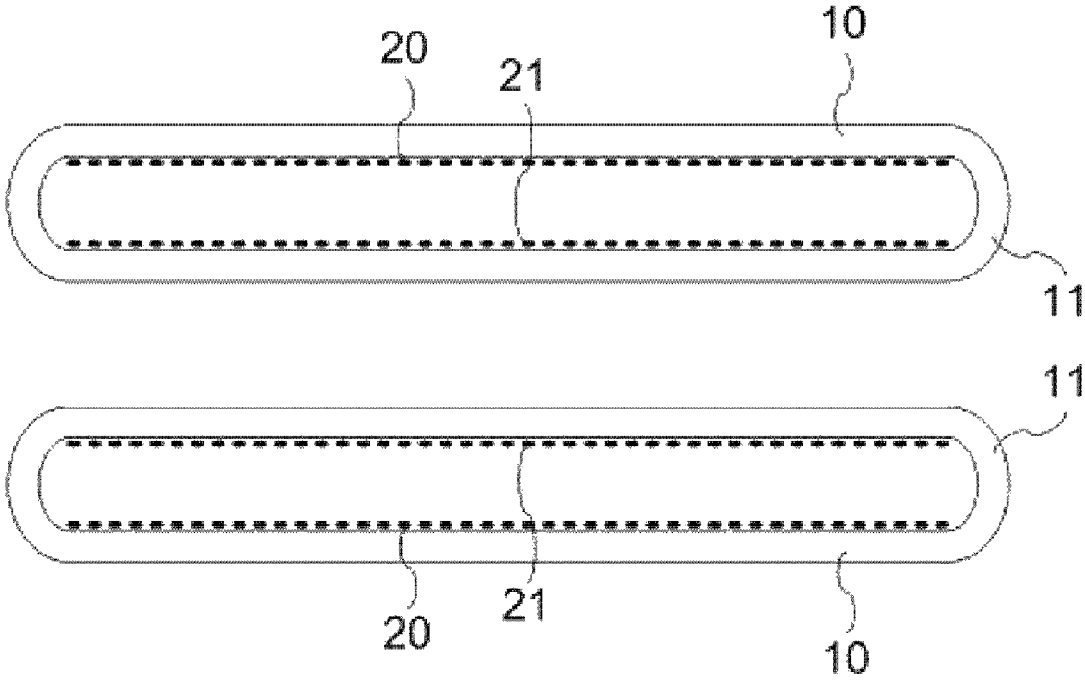
FIG. 1c Prior Art
FIG. 1C is a cross sectional view taken in a longitudinal direction of a double tube fluorescent lamp of FIG. 1A.
Figure 2:
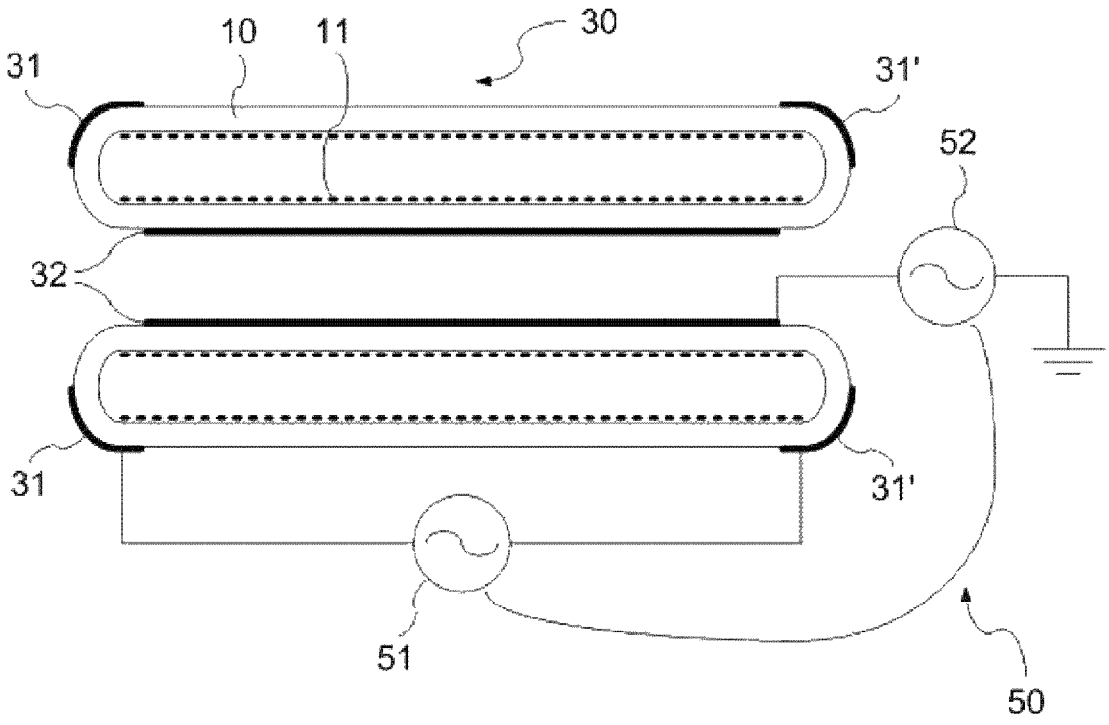
FIG. 2 is a view illustrating a first type of a power supply structure according to the present invention.

FIG. 2 is a view illustrating a first type of a power supply structure according to the present invention. Since the construction of a double tube fluorescent lamp 30 of FIG. 2 is the same as the double tube fluorescent lamp 1 of FIGS. 1A through 1C except for the construction of the external electrodes, the description of the same construction will be omitted.

As shown in FIG. 2, external electrodes are provided at the double tube fluorescent lamp 30, with voltage being applied to the electrodes so as to drive the double tube fluorescent lamp. A pair of first external electrodes 31 and 31' are provided at two ends of the outer glass tube 10 on a circular band shape. A second external electrode 32 is formed at an inner wall surface of the inner glass tube 11 in a cylindrical shape.

The driving apparatus 50 of the double tube fluorescent lamp comprises a first power source 51 and a second power source 52. Here, the first power source 51 is electrically connected with the first external electrodes 31 and 31', respectively, and the second electric power source 52 is electrically connected with the second external electrode 32.

Figure 9A:
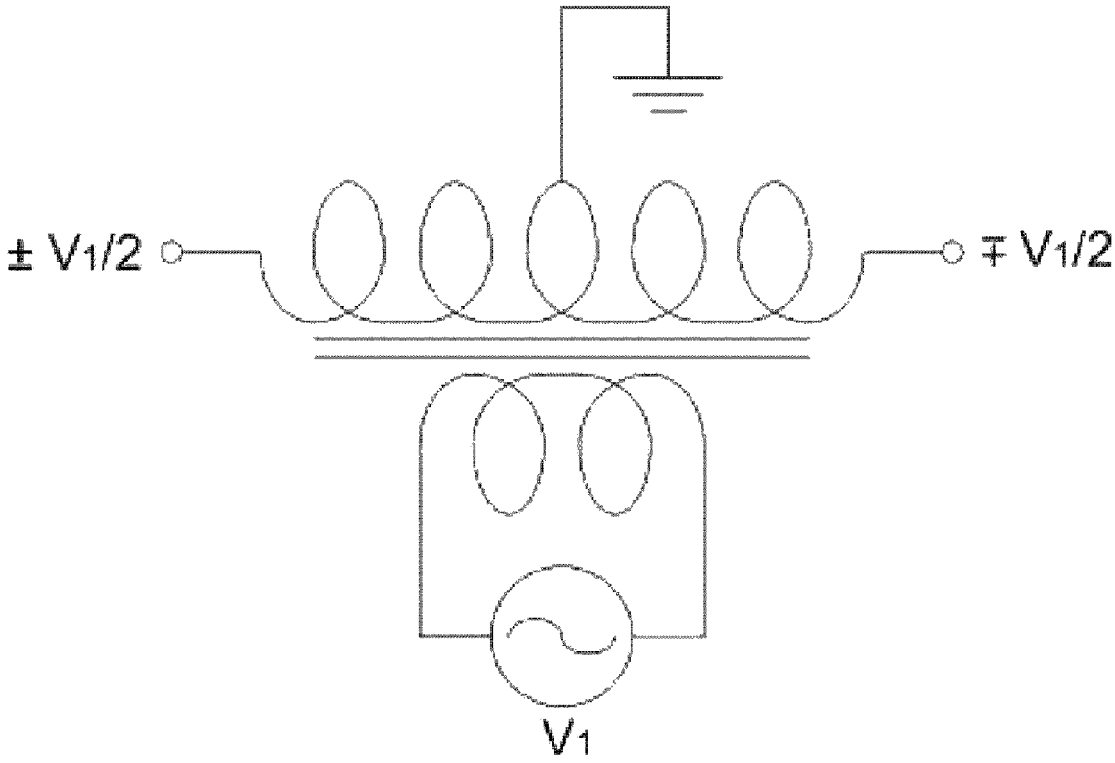
FIGS. 9A and 9B are conception views illustrating a power source of a double tube fluorescent lamp according to the present invention.
Figure 9B:
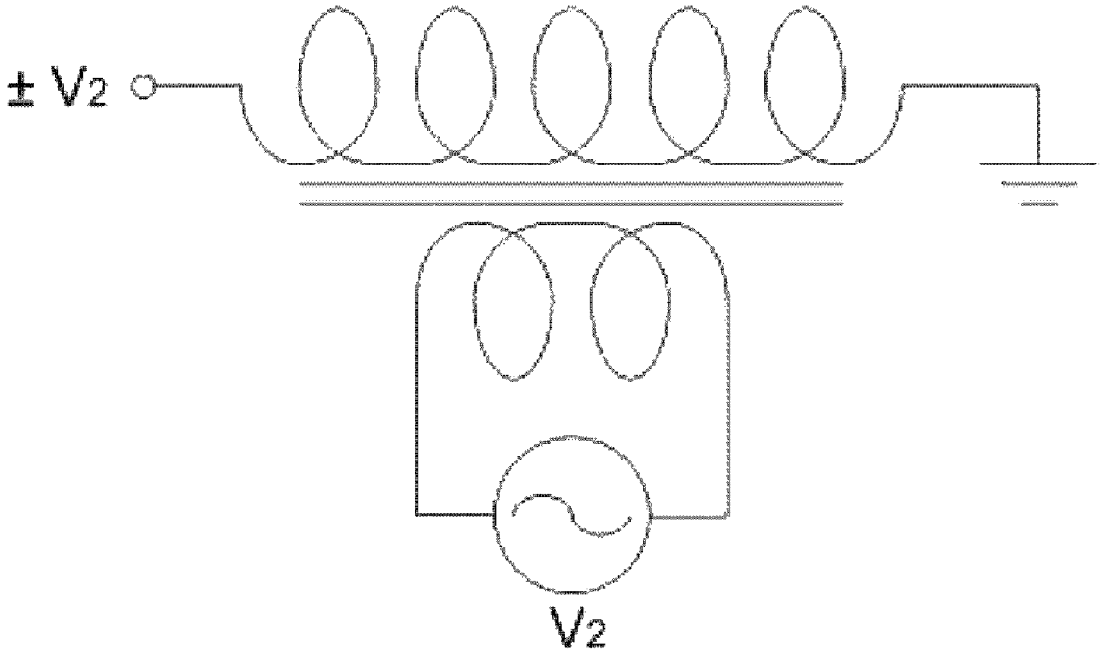

The first and second power sources 51 and 52 are provided with at least one transformer, respectively. FIGS. 9A and 9B are conception views of the above power sources.

As shown in FIGS. 9A and 9B, the first power source 51 is formed of a primary coil and a secondary coil which are connected with the power source having V1. An intermediate portion of the secondary coil is connected with the ground so that the same voltages of different poles are applied to two ends of the secondary coil. Two ends are electrically connected with the first external electrodes 31 and 31'.

The second power source 52 is formed of a primary coil and a secondary coil which are connected with the power source having V2. One end of the secondary coil is connected with the ground, and the other end of the same is electrically connected with the second external electrode 32, so that the same voltages having the opposite poles are alternately supplied to the second external electrode 32.

As shown in FIGS. 9A and 9B, the first and second power sources may be formed of multiple transformers. In the case that the first and second power sources are formed of multiple transformers, the primary and secondary coils may be connected in series or in parallel in the transformers which generate each power source.

When the transformers are constituted based on the series or parallel connections, the heat generation by the power apparatuses may be decreased, and the operation of the double tube fluorescent lamp may be easily controlled.

When the first power source 51 supplies voltage to the first external electrodes 31 and 31', an electric field is formed in the longitudinal direction of the double tube fluorescent lamp, so that plasma is formed in the longitudinal direction of the lamp. In addition, when the second power source 52 supplies voltage to the second external electrode 32, an electric field is formed in a certain direction vertical with respect to the longitudinal direction of the double tube fluorescent lamp, so that plasma is formed in a certain direction vertical with respect to the longitudinal direction of the lamp.

The driving apparatus 50 of the double tube fluorescent lamp according to the present invention is basically directed to generating plasma in a direction vertical with respect to the longitudinal direction using the first and second power sources 51 and 52, so that the plasma is uniformly generated in the discharge space of the double tube fluorescent lamp 30 for thereby effectively preventing the channeling phenomenon of plasma.

The plasma may be more easily generated in the direction from the inner glass tube to the outer glass tube using the voltage V2 supplied from the second power source which is lower than the conventional voltage. The voltage V1 applied to the first power source has a relatively lower value as compared to the voltage value applied in the longitudinal direction in the driving apparatus which uses one power source.

In the driving apparatus of the double tube fluorescent lamp according to the present invention, the double tube fluorescent lamp may be driven with a relatively lower voltage, so that the plasma may be easily generated, and the maintenance is improved. A discharge efficiency may be significantly improved.

Figure 3:
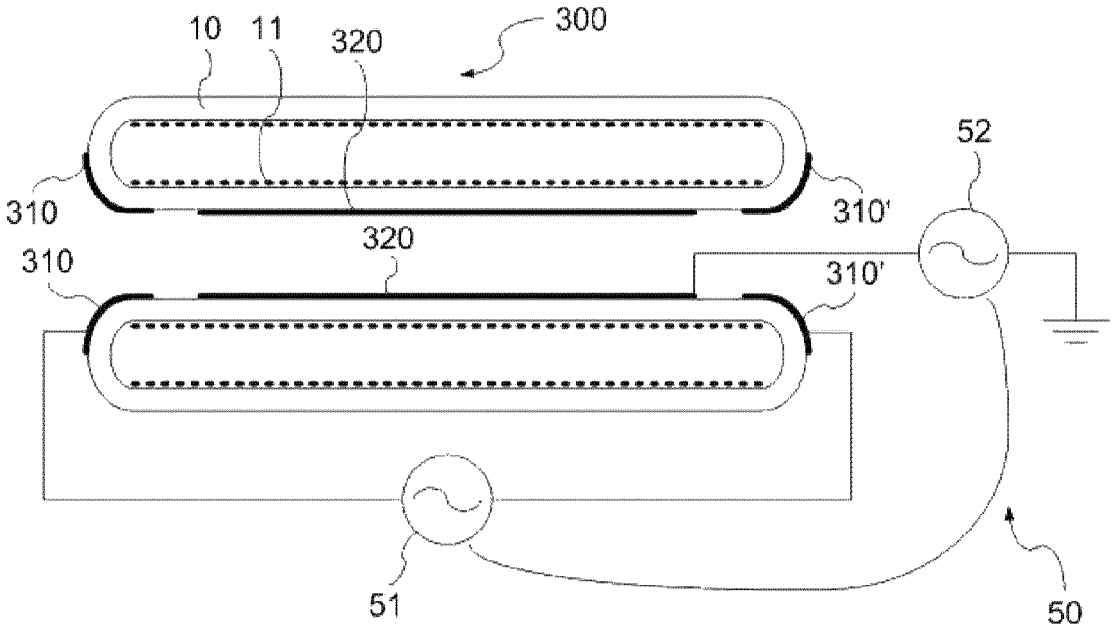
FIG. 3 is a view illustrating a second type of a power supply structure according to the present invention.

FIG. 3 is a view illustrating a second type of a power supply structure according to the present invention. The construction of the driving apparatus 50 is similar with the driving apparatus of FIG. 2 except that the construction of the external electrodes connected with the first and second power sources 51 and 52 are different from the construction of the apparatus of FIG. 2.

As shown in FIG. 3, a pair of first external electrodes 310 and 310' are formed at two ends of the glass tube 11 in a circular band shape differently from the pair of the first external electrodes 31 and 31' of the double tube fluorescent lamp of FIG. 2. Namely, the first external electrodes 310 and 310' and the second external electrode 320 of the double tube fluorescent lamp 300 are all installed at the inner glass tube 11.

The first external electrodes 310 and 310' are installed at the inner glass tube 11, so that it is possible to prevent any interference of the light, which is discharged to the outside by the fluorescent light of the lamp, due to the first external electrode.

The driving method of the lamp is the same as the driving apparatus of FIG. 2. Namely, the plasma is generated in the longitudinal direction of the lamp by the first power source 51 connected with the first external electrodes 310 and 310', and the plasma is generated in a direction vertical with respect to the longitudinal direction of the lamp by the second power source 52 connected with the second external electrode 320.

In this case, the first external electrodes 310 and 310' and the second external electrode 320 are all installed at the inner glass tube 11. When the intervals between them are too close, the driving current may leak as the voltage is applied. So, the second external electrode 320 is preferably installed at a certain interval from the first external electrodes 310 and 310'. The second external electrode 320 of FIG. 3 has a relatively shorter length in the longitudinal direction of the lamp as compared to the construction of FIG. 2.

Figure 4:
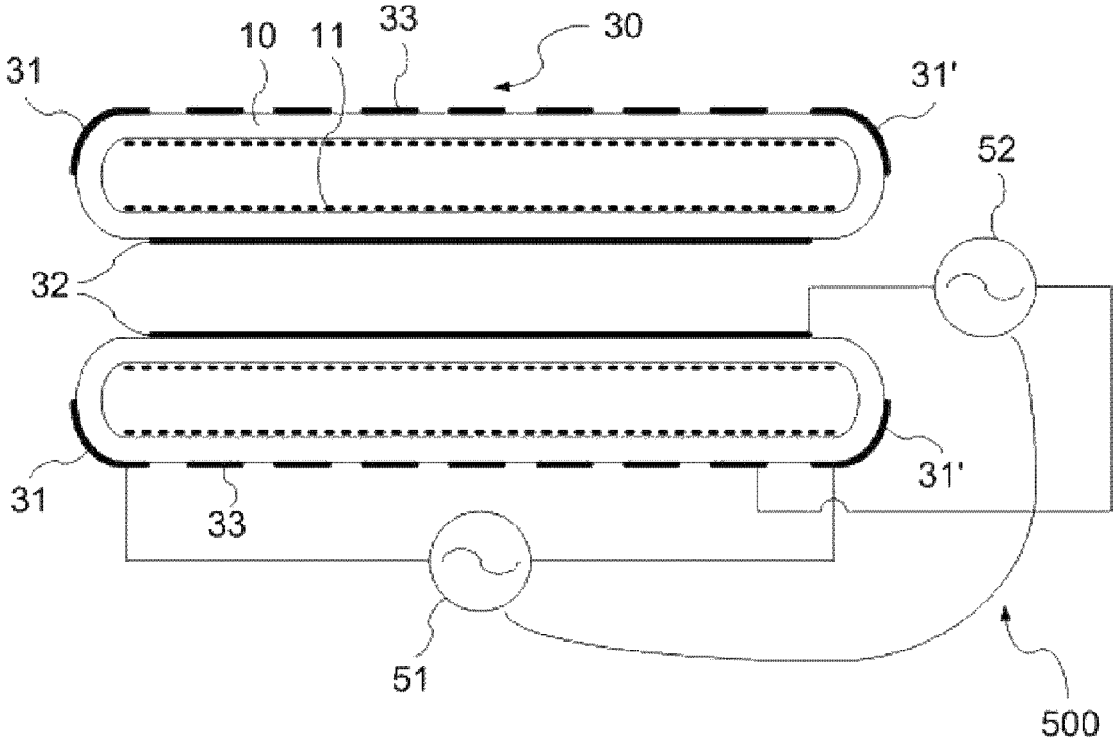
FIG. 4 is a view illustrating a third type of a power supply structure according to the present invention.

FIG. 4 is a view illustrating a third type of a power supply structure according to the present invention. As shown therein, there is provided a driving apparatus 500 which drives the double tube fluorescent lamp 30 in which a third external electrode 33 is additionally provided at an outer wall surface of the outer glass tube 10 of the double tube fluorescent lamp 30 of FIG. 2.

Figure 5:
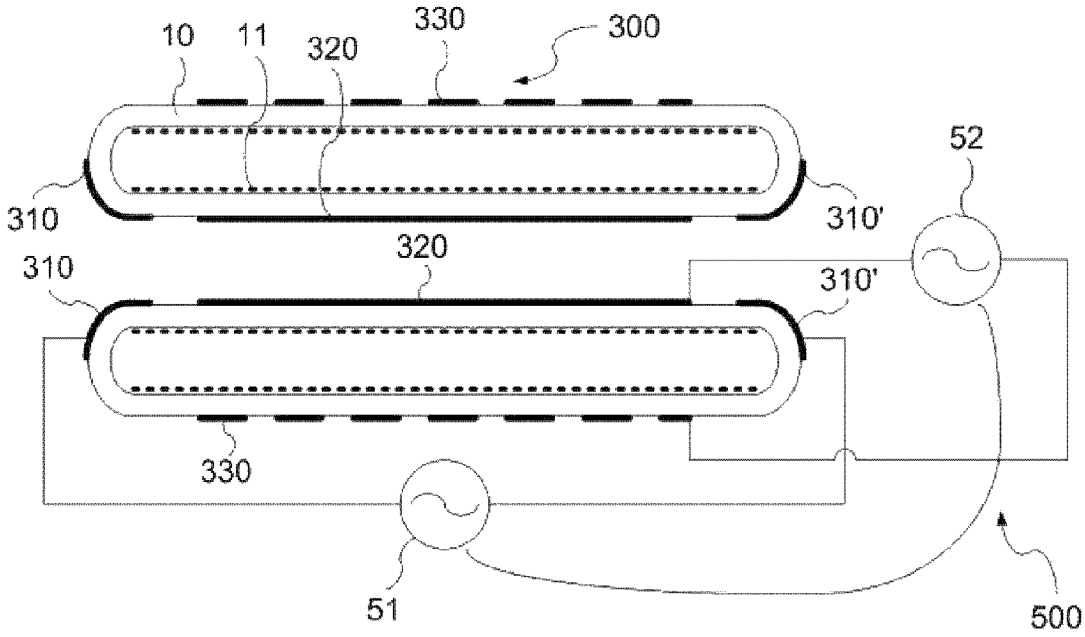
FIG. 5 is a view illustrating a fourth type of a power supply structure according to the present invention.

In addition, FIG. 5 is a view illustrating a fourth type of a power supply structure according to the present invention. As shown therein, there is provided a driving apparatus 500 which drives the double tube fluorescent lamp 300 in which a third external electrode 330 is additionally provided at an outer wall surface of the external glass tube 10 of the double tube fluorescent lamp 300 of FIG. 3.

Here, the lamp driving apparatus 500 comprises a first power source 51 connected with the first external electrodes 31, 31', 310 and 310' and a second power source 52 connected with the third external electrodes 33 and 330.

The first power source 51 allows the plasma to be generated in the discharge space in the longitudinal direction of the lamp like the first power source of FIGS. 2 and 3. The second power source 52 allows the plasma to be generated in the direction vertical with respect to the longitudinal direction of the lamp. At this time, the second power source 52 is not formed of the power of FIG. 9B, but formed of the power of FIG. 9A. Two ends of the secondary coil of the transformer provided at the second power source 52 are connected with the second external electrodes 32 and 320 and the third external electrodes 33 and 330 for thereby supplying power.

The third external electrodes 33 and 330 are formed at the outer wall surface of the outer glass tube 10. As a result, the third external electrodes may be in the middle of the path of light which is emitted to the outside of the lamp, so that the light may be disconnected, At this time, the disconnection of light is prevented or minimized using a certain type of electrode. Preferably, a mesh shaped electrode or an electrode formed of a spiral conductive material may be used for thereby minimizing the disconnection of light. A transparent electrode made of a conductive transparent material may be preferably adapted.

Figure 6:
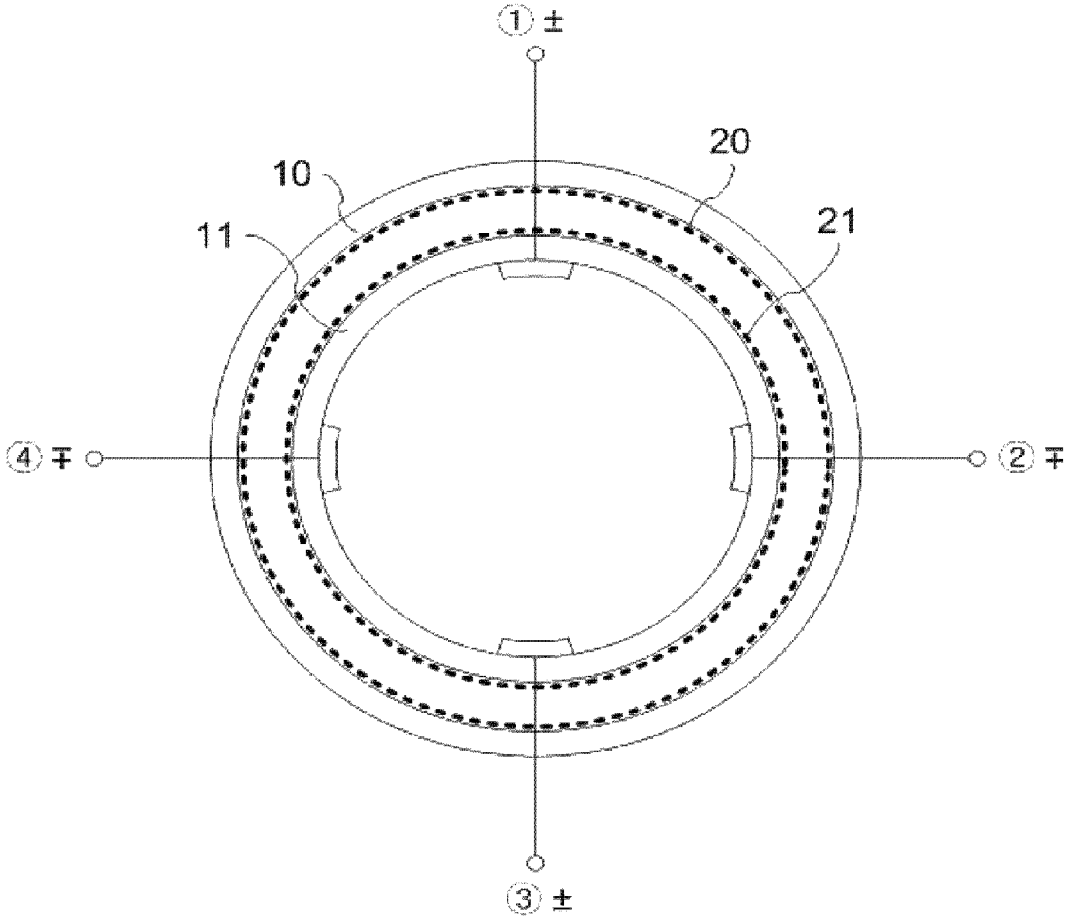
FIG. 6 is a cross sectional view taken in a vertical longitudinal direction of a double tube fluorescent lamp according to a first embodiment of the present invention.

FIG. 6 is a cross sectional view taken in a vertical longitudinal direction of a double tube fluorescent lamp according to a first embodiment of the present invention. In this embodiment of the present invention, the power supply structures of the first and second types of the double tube fluorescent lamp of FIGS. 2 and 3 are adapted.

As shown in FIG. 6, in the first embodiment of the present invention, the four second electrodes 32 and 320 formed in the inner glass tube 11 in the longitudinal direction are arranged in the radial shape in the direction vertical with respect to the longitudinal direction of the inner glass tube for thereby achieving a multi-electrode construction. The power is supplied so that the opposite poles are provided between the neighboring second electrodes 32 and 320, so that the intensity of the plasma is largely enhanced as compared to when forming based on a single electrode for thereby implementing a high luminance double tube fluorescent lamp.

For example, the power of + (−) is supplied to the terminal ①, and the power of − (+) is supplied to the terminal ②. In the same manner, the powers of + (−) and − (+) are supplied to the terminals ③ and ④, respectively, so that the electric field is generated between the neighboring terminals, and the plasma is generated thereby. So, the intensity of the plasma may be significantly enhanced as compared to the single power.

Figure 7:
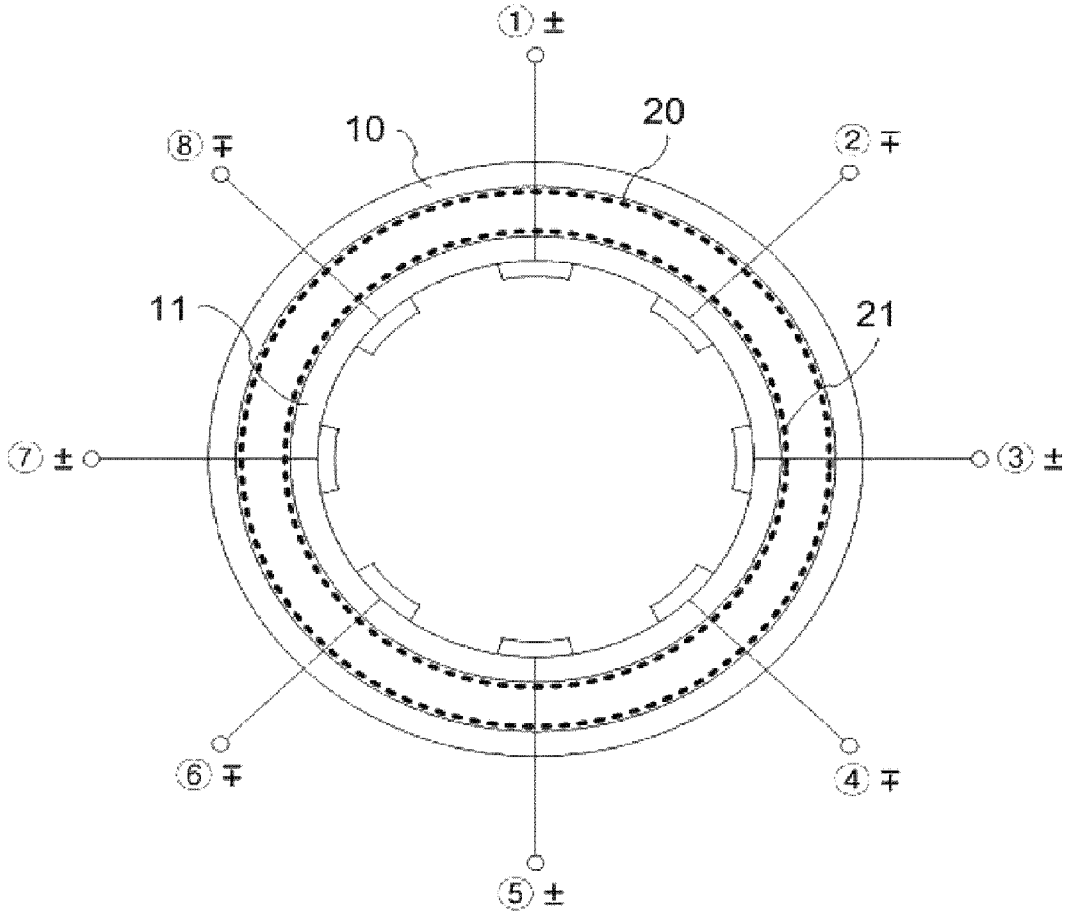
FIG. 7 is a cross sectional view taken in a vertical longitudinal direction of a double tube fluorescent lamp according to a second embodiment of the present invention.

FIG. 7 is a cross sectional view taken in a vertical longitudinal direction of a double tube fluorescent lamp according to a second embodiment of the present invention, which is adapted to the first and second types of the double tube fluorescent lamp of FIGS. 2 and 3.

As shown in FIG. 7, in the second embodiment of the present invention, eight second electrodes 32 and 320 are provided at the inner glass tube 11 in the multiple electrode structure. The power is supplied so that the neighboring electrodes have opposite poles. Since the second embodiment of the present invention is a simple expansion of the first embodiment of FIG. 6, the descriptions of the same will be omitted.

Figure 8:
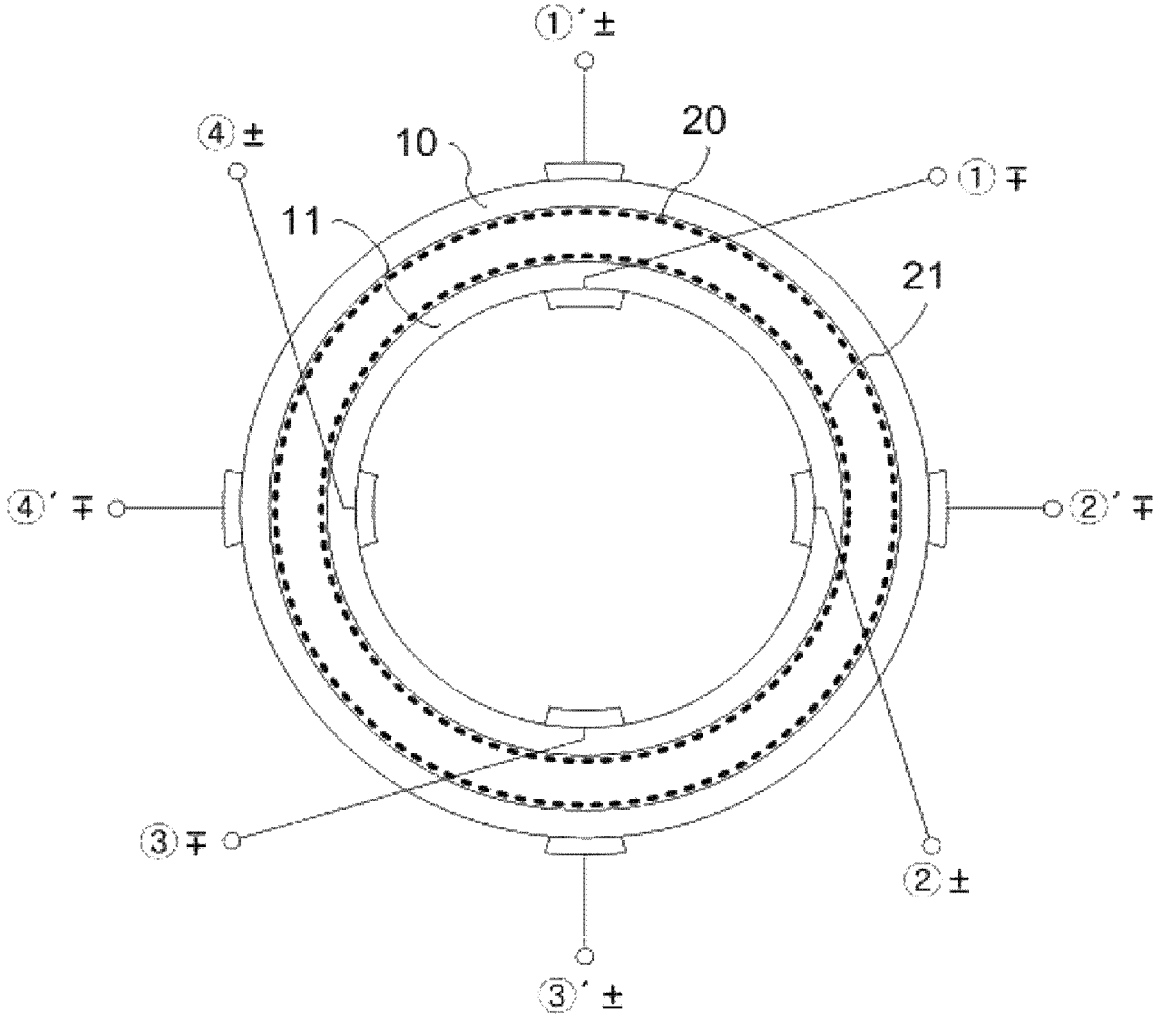
FIG. 8 is a cross sectional view taken in a vertical longitudinal direction of a double tube fluorescent lamp according to a third embodiment of the present invention.

FIG. 8 is a cross sectional view taken in a vertical longitudinal direction of a double tube fluorescent lamp according to a third embodiment of the present invention, which is adapted to the third and fourth types of power supply structures of the double tube fluorescent lamp of FIGS. 4 and 5.

As shown therein, four second electrodes 32 and 320 are arranged at the inner glass tube 11 in the longitudinal direction in a radial multiple electrode structure. The power is supplied so that the neighboring poles have the opposite poles. Four third electrodes 33 and 330 are arranged at the outer glass tube 10 in the longitudinal direction in a radial multiple electrode structure. The power is supplied so that the neighboring electrodes have the opposite poles. With the above construction, it is possible to significantly enhance the intensity of the plasma as compared to a single electrode structure. A high luminance double tube fluorescent lamp may be implemented in the present invention.

Namely, the poles of − (+) may be applied to the terminal ① with respect to the second electrodes 32 and 320, and the poles of + (−) may be applied to the terminal ②, and the poles of + (−) may be applied to the terminal ④, and the poles of + (−) may be applied to the terminal ①' of the third electrodes 33 and 330, and the poles of − (+) may be applied to the terminal ②', and the poles of + (−) may be applied to the terminal ③', and the poles of − (+) may be applied to the terminal ④'. So, the electric field may be formed between each neighboring electrodes, and the plasma is generated thereby. The intensity of the plasma may be significantly enhanced as compared to a single power structure.

The first and second powers used for the double tube fluorescent lamp according to the present invention may be formed of an inverter or a converter having a transformer of FIGS. 9A and 9B. The output voltages of the first and second power sources are differently set.

Here, the different output voltages of the first and second power sources are not limited. In another embodiment of the present invention, the output voltage, driving current, driving frequency and waveform of each power source may be selectively used or may be combined and used by sharing part of the circuits of the first and second power sources.

The driving frequency of the power source provided at the double tube fluorescent lamp according to the present invention is preferably ranged from a few tens of kHz bandwidth to a few MHz of high frequency bandwidth.

INDUSTRIAL APPLICABILITY

As described above, the multi-electrode double tube fluorescent lamp according to the present invention is basically directed to driving a double tube fluorescent lamp by generating plasma in a certain direction vertical with respect to the longitudinal direction of each lamp based on two power sources. The uniformity of plasma generated in the discharge space of the lamp is significantly improved. The channeling phenomenon of plasma is prevented. The luminance of the double tube fluorescent lamp can be improved.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A multi-electrode double tube fluorescent lamp, comprising:

an outer glass tube;

an inner glass tube concentrically formed in the interior of the outer glass tube;

a discharge space formed between the outer glass tube and the inner glass tube;

a pair of first external electrodes formed at two ends of the outer glass tube;

second external electrodes formed at an inner wall surface of the inner glass tube in a longitudinal direction, wherein said second external electrodes are arranged in a radial shape in a direction vertical with respect to the longitudinal direction of the inner glass tube for thereby implementing a multiple electrode structure, with power being supplied so that opposite poles are formed between neighboring electrodes;

a first power source connected with the first external electrode and guides a discharge of the longitudinal direction of the double tube florescent lamp;

a second power source connected with at least one of the second external electrodes and guides a discharge in a direction vertical with respect to the longitudinal direction of the double tube florescent lamp, wherein the direction of the plasma generated by the first power source and the direction of the plasma generated by the second power source are vertical to each other, and third external electrodes formed along an outer surface of the outer glass tube and connected with the second power source, wherein said third external electrodes are formed in a radial shape in a direction vertical with respect to the longitudinal direction for thereby implementing a multiple electrode structure, with power being supplied so that the opposite poles are formed between the neighboring electrodes.

2. A multi-electrode double tube fluorescent lamp, comprising:

an outer glass tube;

an inner glass tube concentrically formed in the interior of the outer glass tube;

a discharge space formed between the outer glass tube and the inner glass tube;

a pair of first external electrodes formed at two ends of the inner glass tube;

second external electrodes formed at an inner wall surface of the inner glass tube in a longitudinal direction, wherein said second external electrodes are arranged in a radial shape in a direction vertical with respect to the longitudinal direction of the inner glass tube for thereby implementing a multiple electrode structure, with power being supplied so that the opposite poles are formed between neighboring electrodes;

a first power source connected with the first external electrode and guides a discharge of the longitudinal direction of the double tube florescent lamp;

a second power source connected with at least one of the second external electrodes and guides a discharge in a direction vertical with respect to the longitudinal direction of the double tube florescent lamp, wherein the direction of the plasma generated by the first power source and the direction of the plasma generated by the second power source are vertical to each other; and third external electrodes formed along an outer surface of the outer glass tube and connected with the second power source, wherein said third external electrodes are formed in a radial shape in a direction vertical with respect to the longitudinal direction for thereby implementing a multiple electrode structure, with power being supplied so that the opposite poles are formed between the neighboring electrodes.

3. The lamp of claim 1, wherein said first and second power sources are provided with at least one transformer, respectively, and the first external electrode is connected with two ends of the secondary coil of at least one transformer of the first power source, and at least one of the second external electrodes is connected with one end of the secondary coil of at least one transformer of the second power source.

4. The lamp of claim 3, wherein said first and second power sources each have at least one different element among a driving voltage, a driving current, a driving frequency, a wave form, an oscillation method and a switching method.

5. The lamp of claim 3, wherein said first and second power sources each have at least two transformers, and the primary and secondary coils of at least two transformers are connected with each other in series or in parallel.

6. The lamp of claim 3, wherein said first and second power sources have driving frequencies ranged from a few tens of kHz to a few of MHz.

7. The lamp of claim 1, wherein said third external electrode is formed of a transparent electrode, a mesh type electrode or a spiral type electrode.

8. The lamp of claim 2, wherein said first and second power sources are provided with at least one transformer, respectively, and the first external electrode is connected with two ends of the secondary coil of at least one transformer of the first power source, and at least one of the second external electrodes is connected with one end of the secondary coil of at least one transformer of the second power source.

9. The lamp of claim 2, wherein at least one of said third external electrodes is formed of a transparent electrode, a mesh type electrode or a spiral type electrode.

* * * * *